United States Patent [19]

Nishida

[11] Patent Number: 4,635,580

[45] Date of Patent: Jan. 13, 1987

[54] SHELL OF SMALL-SIZED MARINE CRAFT

[75] Inventor: Hiroshi Nishida, Miki, Japan

[73] Assignee: Kawasaki Jukogyo Kabushiki Kaisha, Japan

[21] Appl. No.: 743,677

[22] Filed: Jun. 11, 1985

[30] Foreign Application Priority Data

Jun. 13, 1984 [JP] Japan ..... 59-87907[U]

[51] Int. Cl.[4] ..... B63B 5/24

[52] U.S. Cl. ..... 114/343; 114/56; 114/357

[58] Field of Search ..... D12/307; 114/56, 61, 114/270, 292, 271, 343, 355, 357

[56] References Cited

U.S. PATENT DOCUMENTS

| | | | |
|---|---|---|---|
| 3,790,977 | 2/1974 | Bombardier et al. | 114/357 |
| 3,974,535 | 8/1976 | Guanzini | 114/61 |

FOREIGN PATENT DOCUMENTS

| | | | |
|---|---|---|---|
| 2534336 | 5/1976 | Fed. Rep. of Germany | 114/343 |
| 1187283 | 3/1959 | France | 114/357 |
| 175487 | 10/1982 | Japan | 114/355 |
| 922792 | 4/1963 | United Kingdom | 114/355 |

*Primary Examiner*—Sherman D. Basinger

*Attorney, Agent, or Firm*—Leydig, Voit & Mayer

[57] ABSTRACT

A shell of a small-sized marine craft constituted by a deck and a hull jointed together. A seat is formed on a rear portion of the deck. The deck has an upper flange formed on the outer periphery thereof, while the hull is provided with a lower flange formed on its periphery such as to project laterally outwardly therefrom. The upper and lower flanges are jointed together to connect the deck and the hull to each other. The upper and lower flanges are inclined upwardly and forwardly at the bow portion of the shell.

1 Claim, 3 Drawing Figures

SHELL OF SMALL-SIZED MARINE CRAFT

BACKGROUND OF THE INVENTION

1. Field of the Invention

The present invention relates to a shell of a small-sized marine craft for use in marine sports or for leisure purposes, which is suited to running about the sea area near the shore under the control of a rider on the stern portion of the shell who grips a handle bar standing up from the bow portion of the shell. More particularly, the invention is concerned with the shape of the shell of such marine craft of the type mentioned above.

2. Description of the Related Art

In general, a small-sized marine craft of the kind described has an engine mounted in an engine room formed in the bow portion of the shell and a propulsion means provided at the stern portion of the same. The rider stands up or sits on a deck portion formed on the shell to the rear of the engine room and grips the steering handle bar on the bow portion of the shell.

The shell has a breadth which is substantially equal to or slightly greater than the shoulder breadth of a rider.

The propulsion means may be a propeller or a pumped water jet. Where a pumped water jet is used, the marine craft can be steered by changing the direction of the jet.

This type of marine craft is generally light in weight and has an excellent running performance. For instance, it can run at a considerably high speed of 50 km/h or so. Thus, the running performance is largely affected by the shape of the shell.

In known marine craft of the type described, the shell is usually composed of two parts: namely, a deck constituting the upper part of the shell and a hull constituting the bottom of the shell. The deck and the hull are provided with substantially flat joint surfaces extending from the bow to the stern and are jointed together at these joint surfaces such that the deck and the hull together present a smooth outer side surface of the shell with no projection. Alternatively, the joint surfaces are extended horizontally outwardly to provide joint flanges which project laterally from the shell side when the deck and the hull are jointed together.

A continuous smooth side surface of the shell, however, imposes a problem in that the water tends to flood the deck and invades the air inlet of the engine or the space in the shell when the marine craft turns sharply or when the sea is rather rough. Flooding of the deck by water cannot be completely prevented even when the shell has a jointing flange projecting laterally therefrom. Use of a jointing flange, in addition, produces another problem in that water rising up to the bow portion of the marine craft during running acts to develop a downward force on the flange portion around the bow such as to cause a moment which depresses the bow, often resulting in an accidental stall in a halfsubmerged state.

In order to avoid such an accidental stall, it has been proposed that the length of the shell be increased such as to allow effective use of the buoyance at the bow portion of the shell. This countermeasure, however, runs against the demand for reduction in the size and weight of the marine craft of the kind described, and makes it difficult to improve the running performance.

SUMMARY OF THE INVENTION

Accordingly, an object of the invention is to provide a shell of a small-sized marine craft having a specific shape which effectively prevents flooding of the deck even during sharp turning of the marine craft, not to mention the case of straight running, while eliminating any tendency of the bow to submerge.

The shell of the small-sized marine craft in accordance with the invention is constituted by a deck and a hull jointed together. A seat for the rider is provided on the deck near the stern. The deck has an upper flange projecting laterally outwardly from the periphery thereof, while the hull has a lower flange which projects laterally outwardly from the periphery thereof. The deck and the hull are connected to each other as the upper and lower flanges are jointed together. The upper and lower flanges are inclined upwardly and forwardly at the bow portion of the shell.

DESCRIPTION OF THE PREFERRED EMBODIMENTS

Figure 1:
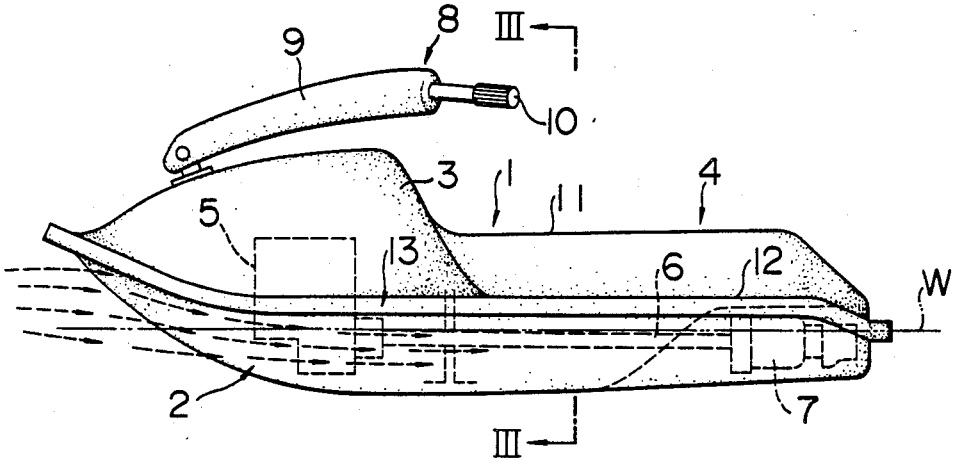
FIG. 1 is a side elevational view of a small-sized marine craft having an embodiment of the invention.
Figure 2:
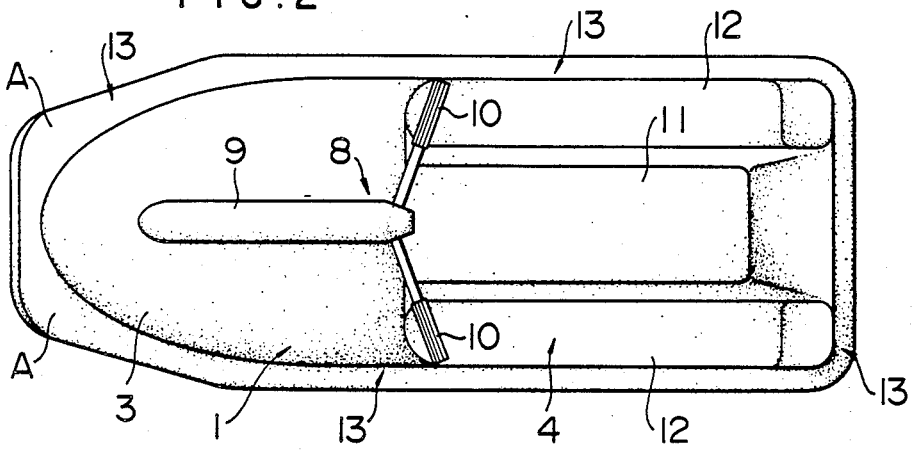
FIG. 2 is a plan view of the small-sized marine craft shown in FIG. 1.
Figure 3:
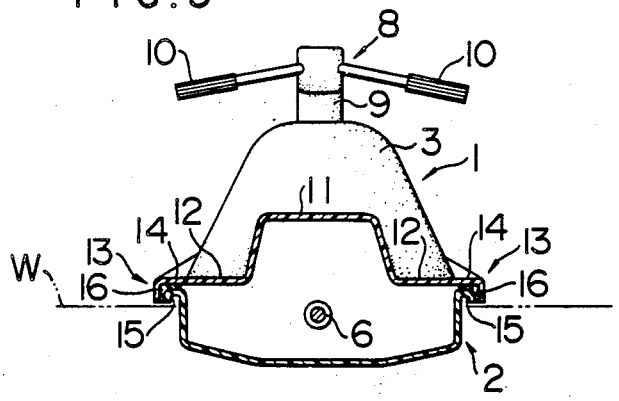
FIG. 3 is a cross-sectional view taken along the line III—III of FIG. 1.

Referring to FIGS. 1 to 3, a small-sized marine craft has a shell which is composed of a deck 1 and a hull 2 jointed together, such that the deck 1 constitutes the upper portion of the shell while the hull 2 forms the bottom of the same. An engine 5 is mounted in an engine room which is formed in a bow portion of the shell. A rear deck 4 behind the engine room 3 provides a seat for the rider.

The engine room 3 accommodates various auxiliary machines besides the engine 5. A propeller 7 installed at a rear portion of the hull bottom is adapted to be driven by the engine 5 through a drive shaft 6.

A steering handle device generally designated at a numeral 8 is provided on a bow portion of the marine craft. More specifically, the steering handle device 8 includes a vertically swingable boom 9 extending along the upper side of the engine room 3 and handle bars 10,10 attached to the rear end of the boom 9. The rider on the rear deck 4 grips the grip portions of the handle bars 10,10 such as to support himself and to control the marine craft. The rear deck 4 is formed with a protrusion at its central portion such as to provide a projecting seat 11 and with steps 12,12 on both sides of the seat 11.

The deck 1 and the hull 2 are jointed together at a flange joint 13 extending laterally outwardly of the shell.

More specifically, as shown in FIG. 3, the joint flange 13 has an upper flange 14 formed on the periphery of the deck 1, a lower flange 15 formed on the periphery of the hull 2 and a sealing packing 16 sandwiched between these flanges 14,15 and fixed by, for example, a bond. In the illustrated embodiment, both the upper and lower flanges 14 and 15 are bent downwardly at their outer extremities so that the bonding area is increased to provide a higher sealing effect.

The joint flange 13 has a suitable width and extends over the entire periphery of the shell.

From FIG. 1, it will be seen that the joint flange 13 is inclined upwardly and forwardly such that its height is at a maximum at the bow of the shell. In the illustrated embodiment, the upward inclination of the joint flange 13 starts at a portion thereof which is about ⅓ of the whole shell length as measured from the bow. The joint flange 13 extends substantially horizontally from this portion to the stern. Although in the described embodiment the joint flange 13 extends around the entire periphery including the stern portion, this is not exclusive and the stern portion may be left devoid of the joint flange 13.

Preferably, the joint flange 13 has a greater width, i.e., it projects from the shell by a greater amount in the areas A,A on both sides of the bow portion, as will be clearly seen from FIG. 2.

In FIGS. 1 and 3, the normal water line is indicated by the two-dot-and-dash line W.

In the described embodiment of the invention, any high wave ahead of the running marine craft collides with the lower side of the joint flange 13 on the bow side of the craft, and is deflected such as to move along the lower face of the joint flange 13 as shown by broken-line arrows in FIG. 1. It is, therefore, possible to suppress the drenching of the rider by water breaking over the bow, as well as the invasion for the internal space of the shell by rising water through the air inlet. In addition, since the punching by the water acts on the lower side of the joint flange 13, it is possible to avoid the tendency of the bow to submerge which otherwise may be caused by the downward moment mentioned before and, hence, the rider can easily maintain the optimum posture of the marine craft during running, e.g., at a forward elevation angle of about 4°. Thus, the joint flange 13 can serve as a kind of flap.

This effect is obtained also when the body of the marine craft leans to the port or starboard side when being sharply turned. Namely, any tendency to become flooded with water or to submerge are suppressed even during sharp turning of the marine craft.

Although in the described embodiment a projecting seat is provided at the center of the rear deck 4, the invention can be applied equally to a marine craft having a rear deck with both side edges thereof projected upwardly so as to provide a riding floor therebetween.

The use of the boom 9 in the handle device 8 is not essential, and the marine craft can have a steering wheel or bar fixed to the upper end of a rotatable column.

What is claimed is:

1. A shell of a small-sized marine craft comprising:

a deck and a hull joined together, said deck having a raised seat on a rear portion thereof and having laterally and longitudinally-extending flat, horizontal, parallel step portions straddling said seat;

means effective upon forward movement of the craft for deflecting water from breaking over the bow and the sides of the craft including:

a flat upper flange projecting outwardly from the deck at the periphery thereof having flat rear portions extending laterally outwardly from and being coplanar with said step portions and extending horizontally lengthwise of the craft, said flat upper flange having forward portions extending laterally from said deck and extending lengthwise of the craft to the bow portion of said shell, said flat flange being wider on both sides of said bow than at other portions of the periphery of the shell;

a flat lower flange projecting outwardly from the hull at the periphery thereof and conforming to said flat upper flange, the outer extremities of said flat upper and lower flanges being bent downwardly;

a sandwich packing between and bonded to said flanges so as to connect said deck and said hull to each other;

said flat upper and lower flanges being inclined upwardly and forwardly at the portion thereof which extends for about one/third of the whole shell length as measured from the bow end of said shell while the rear part of said flat flanges extends substantially horizontally.

* * * * *